US005768876A

United States Patent [19]

Messing

[11] Patent Number: 5,768,876

[45] Date of Patent: Jun. 23, 1998

[54] BOBBIN TRANSPORT SYSTEMS

[75] Inventor: Robert Messing, St. Helier, Channel Islands

[73] Assignee: Technological Research Company Limited, St. Helier, Channel Islands

[21] Appl. No.: 808,156

[22] Filed: Feb. 28, 1997

Related U.S. Application Data

[63] Continuation of Ser. No. 288,353, Aug. 10, 1994, abandoned.

[51] Int. Cl.[6] ..... D01H 9/10; B61B 3/00; B61C 3/00; B61G 11/00

[52] U.S. Cl. ..... 57/281; 104/94; 105/50; 213/221; 242/35.5 A

[58] Field of Search ..... 242/35.5 A; 57/281, 57/90; 104/93, 94, 95, 103, 130.1, 254; 105/50; 213/221

[56] References Cited

U.S. PATENT DOCUMENTS

| | | | |
|---|---|---|---|
| 2,690,845 | 10/1954 | Macomber | 213/221 |
| 2,897,769 | 8/1959 | Bishop et al. | 104/94 X |
| 3,244,293 | 4/1966 | Stahmer | 105/50 |
| 3,263,626 | 8/1966 | Henderson | 104/93 X |
| 3,380,398 | 4/1968 | Wainwright et al. | 104/95 X |
| 3,541,971 | 11/1970 | Drennan | 105/50 |
| 3,774,548 | 11/1973 | Borst | 104/95 X |
| 3,895,725 | 7/1975 | Mayer | 57/281 X |
| 4,354,434 | 10/1982 | Dehne | 104/103 |
| 4,640,088 | 2/1987 | Lattion | 242/35.5 A X |
| 4,715,288 | 12/1987 | Catena | 104/95 X |
| 4,841,719 | 6/1989 | Sasaki et al. | 57/281 |
| 4,856,270 | 8/1989 | Langen et al. | 57/281 |
| 5,010,725 | 4/1991 | Yasui et al. | 57/281 |
| 5,419,260 | 5/1995 | Hamilton | 104/95 X |

FOREIGN PATENT DOCUMENTS

| | | |
|---|---|---|
| 0 219 017 | 4/1987 | European Pat. Off. . |
| 0 296 298 | 12/1988 | European Pat. Off. . |
| 0 301 252 | 2/1989 | European Pat. Off. . |
| 0 371 215 | 6/1990 | European Pat. Off. . |
| 0 388 937 | 9/1990 | European Pat. Off. . |
| WO 90/12133 | 10/1990 | WIPO . |

*Primary Examiner*—Michael Mansen
*Attorney, Agent, or Firm*—Young & Thompson

[57] ABSTRACT

A drive unit for driving one or more bobbin carriers along a track of a bobbin transport system, comprises track engaging elements for engaging with the track and allowing the drive unit to travel along the track, a detector for detecting position indicators spaced along the track and for producing detector signals, and a computing device for receiving the detector signals from the detector and for computing the location of the drive unit on the basis of the detector signals.

3 Claims, 6 Drawing Sheets

BOBBIN TRANSPORT SYSTEMS

This application is a continuation of application Ser. No. 08/288,353, filed Aug. 10, 1994, now abandoned.

INTRODUCTION

The invention relates to bobbin transport systems.

In the textile industry it is sometimes necessary to transport bobbins around a textile machine. In the case of textile machines comprising roving and spinning frames it may be necessary to transport both full and empty bobbins between the roving frames and the spinning frames.

The invention seek to provide a new and improved bobbin transport system and parts thereof.

SUMMARY OF THE INVENTION

According to the invention there is provided a drive unit for driving one or more bobbin carriers along a track of a bobbin transport system, comprising track engaging means for engaging with the track and allowing the drive unit to travel along the track, a detector for detecting position indicators spaced along the track and for producing detector signals, and computing means for receiving said detector signals from the detector and for computing the location of the drive unit on the basis of said detector signals.

The track engaging means may include one or more wheels or rollers for engaging with the track.

In one embodiment of the invention, the detector is a magnet detector for detecting magnets spaced along the track.

The drive unit may be adapted for use where the track has one or more junctions at which the track divides into two branches and where the or each junction is provided with a direction controlling device for controlling the path which must be taken by the drive unit at the junction.

In this case, the computing means may be adapted to produce control signals for controlling one or more such direction controlling devices so as to enable the drive unit to travel along the track to a required location.

Preferably, the drive unit is adapted to start and stop travelling along the track, and the computing means controls when and where the drive unit starts and stops.

In a preferred embodiment of the invention, the drive unit further comprises connection means for releasably connecting the drive unit to a bobbin carrier.

It will be appreciated that further bobbin carriers could be connected to the bobbin carrier in order to form a line or train of bobbin carriers connected to the drive unit.

Conveniently, the connection means comprises a latch mechanism for automatically connecting the drive unit to the bobbin carrier when the drive unit and the bobbin carrier are brought together so that the connection means comes into contact with the bobbin carrier.

In order to give the connection means two opportunities of successfully connecting the drive unit to the bobbin carrier, the computing means may be adapted to stop the drive unit just after the connection means comes into contact with the bobbin carrier, and then to immediately restart the drive unit.

Conveniently, the computing means is adapted to send a release signal to the connection means when it is required to disconnect the drive unit from the bobbin carrier, and the connection means is adapted to automatically disconnect the drive unit from the bobbin carrier in response to said release signal from the computing means.

The connecting means may comprise an electromagnet for causing the drive unit and the bobbin carrier to become disconnected.

In order to reduce the maximum acceleration experienced by the drive unit and the bobbin carrier when the connection means is brought into contact with the bobbin carrier, the drive unit may further comprise shock absorbing means comprising a resilient device adapted to compress or expand resiliently when the connection means is brought into contact with the bobbin carrier.

The drive unit may further comprise an electric motor for driving the drive unit along the track.

In this case, the drive unit may also comprise a rechargeable battery for powering the electric motor Conveniently, when the rechargeable battery needs recharging, the computing means is adapted to stop the drive unit in a region of the track adapted for recharging of the rechargeable battery.

In this case, the drive unit may further comprise two electrically conducting members for automatically contacting two terminals of a battery charging power supply when the drive unit is located in said region of the track adapted for recharging of the rechargeable battery.

In one embodiment of the invention the drive unit further comprises a rotatably driven wheel for driving the drive unit along the track by means of frictional engagement between the wheel and the tack.

Preferably, the drive unit further comprises pressure control means for increasing the pressure exerted by the wheel on the track as the load on the drive unit increases, so as to maintain sufficient frictional engagement between the wheel and the track.

The pressure control means may operate for both directions of travel of the drive unit along the track, and may comprise a pivot member which pivotally mounts the wheel to the drive unit so that the wheel tends to pivot towards the track when driving the drive unit along the track.

Additionally or alternatively, the drive unit may comprise a rotatably driven toothed wheel for driving the drive unit along the track by means of engagement of the teeth of the tooth wheel within recesses spaced along the track, or along parts of the track.

The drive unit may be adapted to be suspended below the track.

The invention also provides a drive unit as described above in combination with a bobbin carrier for carrying at least one bobbin along the track and having means for engaging with the track.

The invention also provides a bobbin transport system for transporting bobbins around a textile machine having at least one roving frame and at least one spinning frame, comprising a bobbin track having position indicators spaced along its length and including a spinning track for transporting bobbins around the or each spinning frame, a roving track for transporting bobbins around the or each roving frame, and a connecting track connecting the spinning track to the roving track, and a drive unit as described above for driving one or more bobbin carriers along the bobbin track.

Each position indicator may comprise at least one magnet.

In a preferred embodiment of the invention, the bobbin track has a number of junctions at which the bobbin track divides into two branches, and at least one branch of the bobbin track is a storage branch for storing bobbin carriers.

The spinning track may be provided with at least one such storage branch for storing bobbin carriers.

Similarly, the roving track may be provided with at least one such storage branch for storing bobbin carriers.

Preferably, the or each junction is provided with a respective direction controlling device for controlling the path which must be taken by the drive unit at the junction.

Preferably, if the computing means of the drive unit is adapted to produce said control signals, the or each direction controlling device is adapted to receive said control signals from the computing means, and to operate in response to said control signals.

The or each direction controlling device may comprise an elongate tapered member pivotally movable between a first position in which it directs the drive unit to travel along one branch of the bobbin track, and a second position in which it directs the drive unit to travel along another branch of the bobbin track.

In this case, the direction controlling device conveniently comprises an electromagnet for moving the tapered member between said first and second positions.

If the drive unit has a rechargeable battery, the bobbin track may comprise charging region provided with charging means for automatically recharging the rechargeable battery of the drive unit if and when the drive unit stops in said charging region.

The charging region may conveniently be located on the connecting track. If the drive unit is provided with said toothed wheel, one or more parts of the bobbin track may be inclined to the horizontal and the bobbin transport system may be provided with recesses extending along the or each inclined part of the bobbin track, the recesses being formed either in the bobbin track itself or in a member positioned alongside the bobbin track, and being adapted to engage with the teeth of said toothed wheel.

The invention will now be more particularly described, by way of example only, with reference to the accompanying drawings.

DESCRIPTION OF THE PREFERRED EMBODIMENTS

Figure 1:
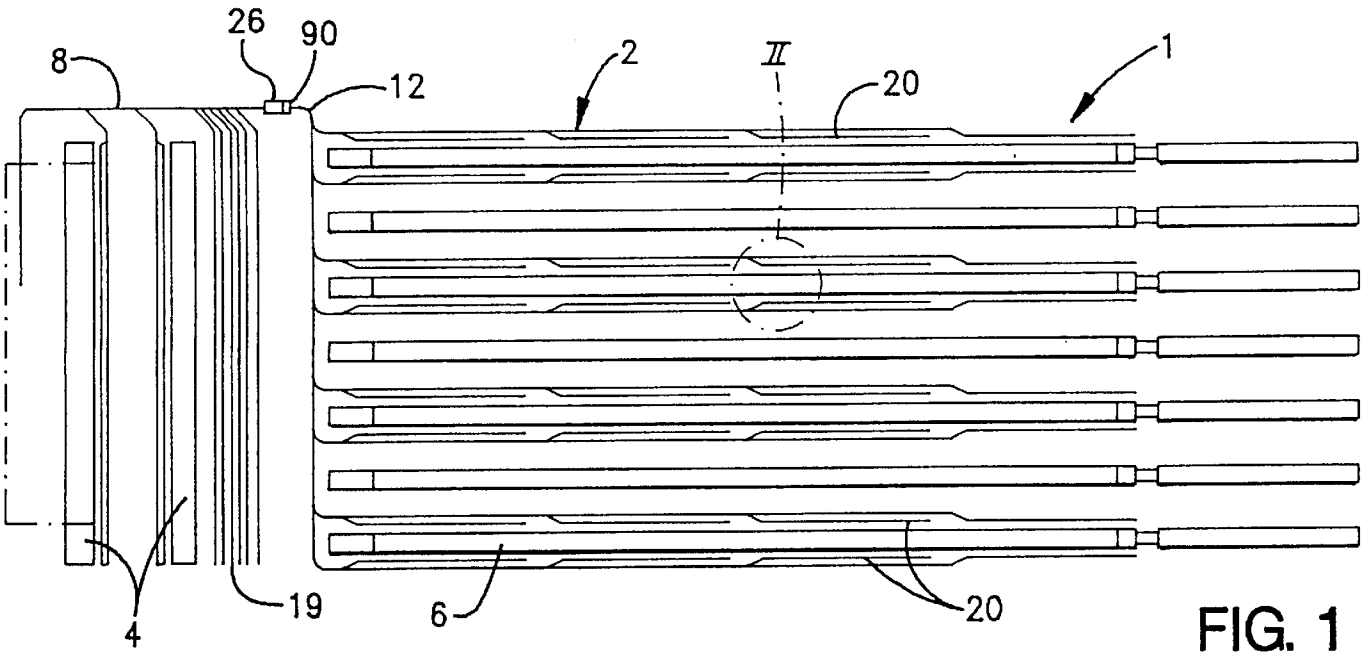
FIG. 1 is a diagrammatic plan view of a bobbin track of a bobbin transport system.

A bobbin transport system 1 comprises a bobbin track 2 connecting each roving frame 4 of a textile machine to each spinning frame 6 of the textile machine. The bobbin track 2 comprises a roving track 8 for transporting bobbins to and from the roving frames 4, a spinning track 10 for transporting bobbins to and from the spinning frames 6, and a connecting track 12 connecting the roving track 8 to the spinning track 10.

Figure 6:
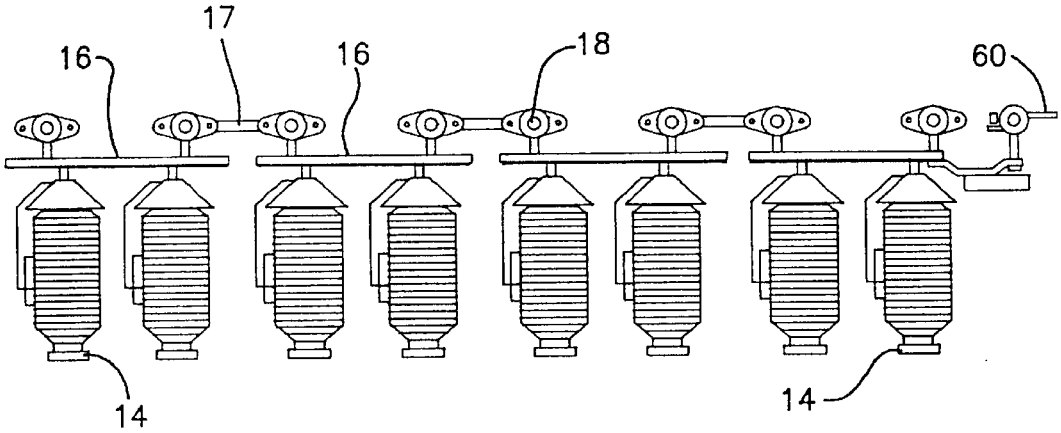
FIG. 6 shows a number of bobbin carriers connected together to form a line or train of bobbin carriers, each bobbin carrier carrying two full bobbins.
Figure 7:
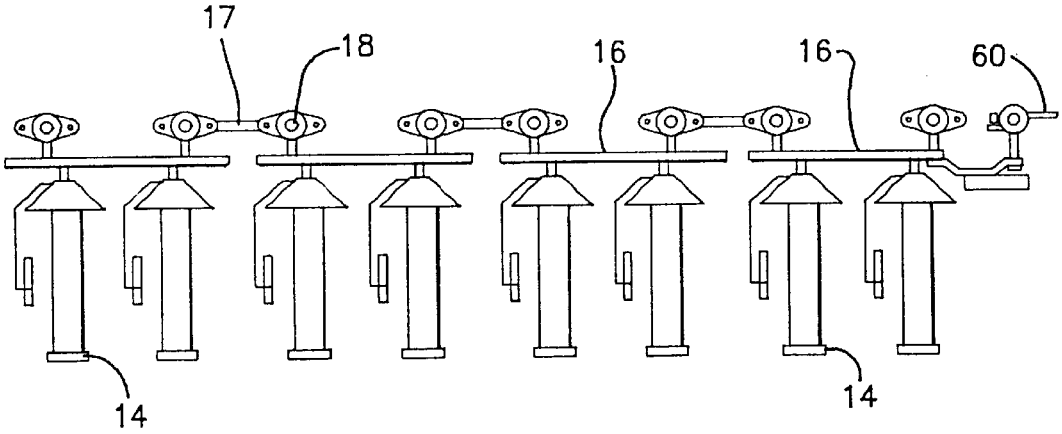
FIG. 7 shows the bobbin carriers of FIG. 6 where each bobbin carrier is carrying two empty bobbins.

The bobbins 14 are carried along the bobbin track 2 by bobbin carriers 16 which are connected together by rods 17 to form a train of bobbin carriers, as shown in FIGS. 6 and 7. The bobbin transport system may comprise a large number of such trains of bobbin carriers. Each bobbin carrier 16 is adapted to carry two bobbins 14 and is provided with two rollers 18 adapted to run within and along the track 2. The bobbin carriers 16 are driven along the bobbin track 2 by means of the drive unit shown in FIG. 3.

Figure 2:
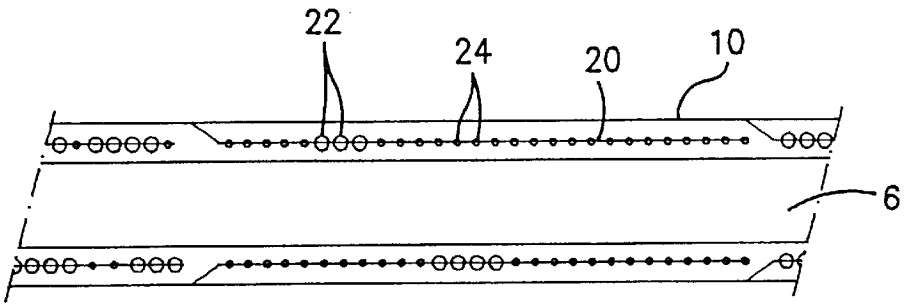
FIG. 2 is an enlarged view of a portion of the bobbin track shown in FIG. 1.

Returning to FIG. 1, the bobbin track 2 comprises a number of junctions at each of which the bobbin track divides into two branches. Some of these branches are storage branches for storing bobbin carriers. In particular, the roving track 8 is provided with six storage branches 19 and the spinning track 10 is provided with further storage branches 20. The storage branches 19 arc grouped together adjacent and parallel to one another, whereas the storage branches 20 are spread out along the length of some of the spinning frames 6. The region marked II in FIG. 1 is shown in greater detail in FIG. 2, which shows some of the storage branches 20 being used to store both full bobbins 22 and empty bobbins 24.

Figure 3:
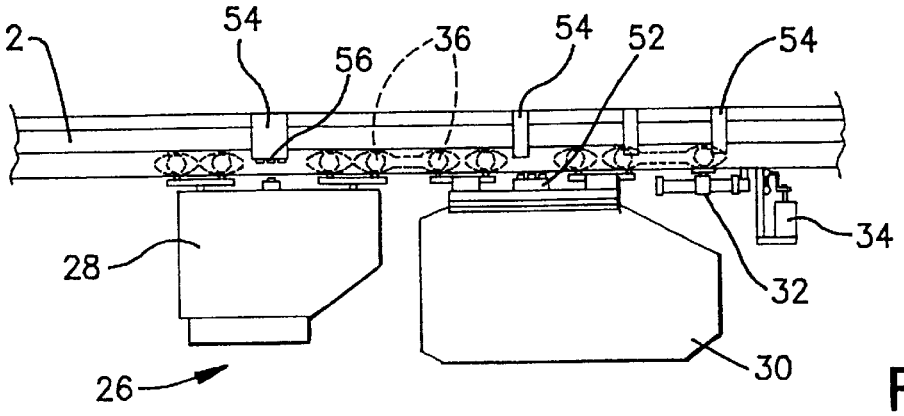
FIG. 3 shows a drive unit suspended from a portion of the bobbin track.

Referring to FIG. 3, the drive unit 26 comprises a battery unit 28, motor unit 30, shock absorbing device 32 and connecting device 34. The drive unit 26 is suspended from the bobbin track 2 by means of rollers 36 which run within and along the bobbin track 2. The motor unit 30, shown in greater detail in FIG. 4, comprises a computing device 38, an electric motor 40 powered by the battery unit 28, and a rubber wheel 42 driven by the motor 40. The rubber wheel 42 is held against the lower side 44 of the track 2 by means of a spring 46 and serves to drive the unit 26 along the track 2.

A magnet detector 52 is provided at the top of the motor unit 30 for detecting position indicators 54, each comprising a magnet, spaced along the track 2, and for sending detector signals to the computing device 38. The computing device 38 is programmed to compute the location of the drive unit on the track 2 on the basis of said detector signals received from the magnet detector 52. Some of the position indicators 54 may comprise two or more magnets 56, and the magnet detector 52 is capable of distinguishing between position indicators 54 having different numbers of magnets 56.

Figure 5:
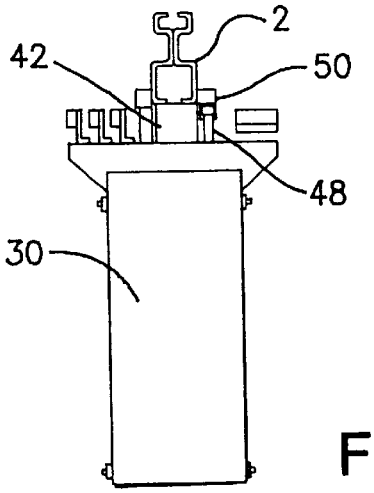
FIG. 5 is an end view of the motor unit shown in FIG. 4.

FIG. 5 is an end view of the motor unit 30, which is provided with a rotatably driven toothed wheel 48, the teeth of which engage within recesses formed in a side member 50 attached to one side of the track 2. The side member 50 is only positioned alongside those parts of the track 2 which are inclined at more than 20° to the horizontal.

Figure 8:
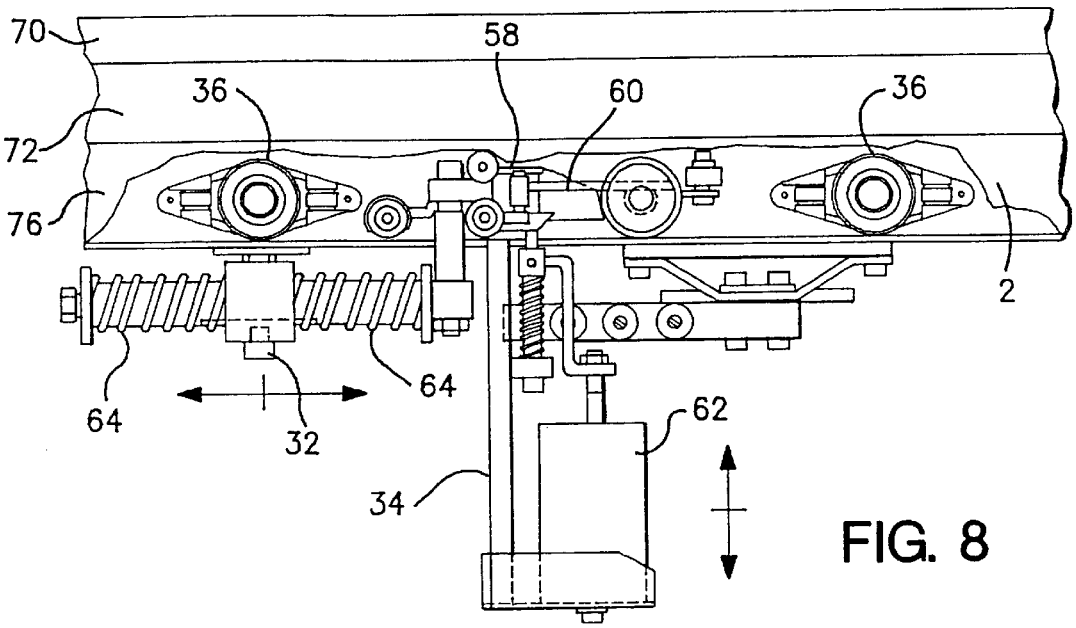
FIG. 8 shows a shock absorbing device and a connecting device which form part of the drive unit of FIG. 3.

FIG. 8 shows the connecting device 34 and the shock absorbing device 32 in greater detail. The connecting device 34 comprises a latch mechanism 58 for engaging with a projecting member 60 (also shown in FIGS. 6 and 7) connected to the end bobbin carrier 16 of a train of bobbin carriers 16. The projecting member 60 automatically engages with the latch mechanism 58 when the latch mechanism 58 and the projecting member 60 are brought together. However, in order to ensure that the projecting member 60 has at least two chances of successfully engaging with the latch mechanism 58, the computing device 38 is programmed to cause the drive unit 26 to stop just after the latch mechanism 58 is brought into contact with the projecting member 60, and then to immediately restart the drive unit 26. The computing device 38 also controls an electromagnet 62 for releasing the latch mechanism 58 when it is required to separate the drive unit 26 from a train of bobbin carriers 16.

The shock absorbing device 32 is positioned between the connecting device 34 and the motor unit 30, and is provided with two springs 64 adapted to resiliently compress when the latch mechanism 58 is brought into contact with the projecting member 60. The shock absorbing device 32 thus serves to reduce the maximum acceleration experienced by a train of bobbin carriers 16 while being connected to the drive unit 26.

Figure 9:
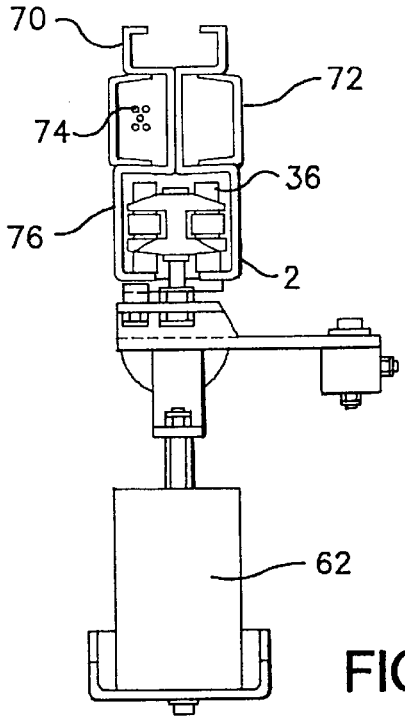
FIG. 9 is a sectional view through a part of the bobbin track.

FIG. 9 shows the construction of the track 2, which is of generally constant cross-sectional shape along its length. The track 2 comprises an upper part 70 for connecting the track to supports (not shown), an enclosed part 72 for carrying electric cables and wires 74, and a lower part 76 within and along which the runners 36 and 18 of the drive unit 26 and bobbin carriers 16 respectively travel.

Figure 10:
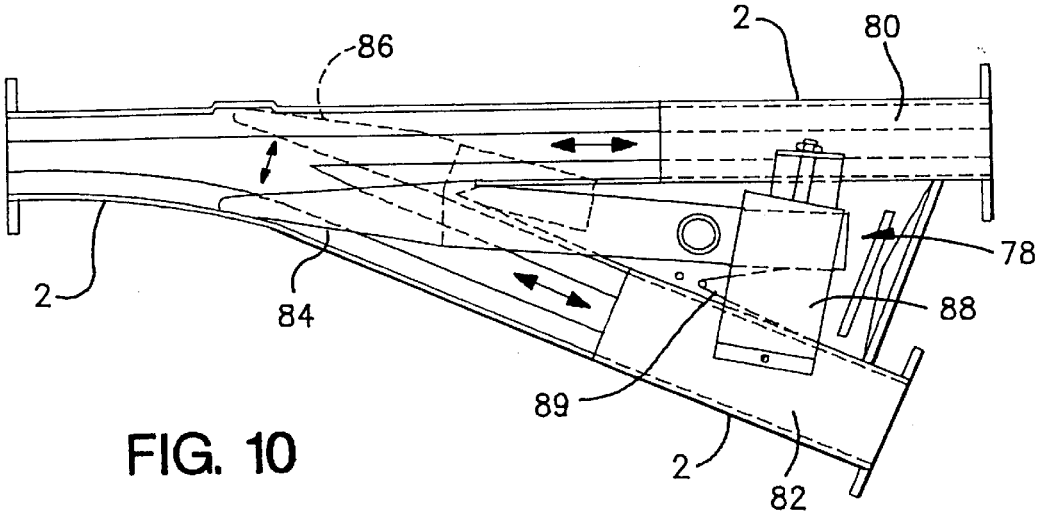
FIG. 10 shows a junction of the bobbin track fitted with a direction changing device.

FIG. 10 shows one of the junctions of the bobbin track 2. The junction is provided with a direction changing device 78 for directing the runners 36 and 18 along either a first branch 80 or a second branch 82 of the bobbin track 2. The direction changing device 78 comprises a tapered elongate member 84 pivotally movable between a first position shown by solid lines in FIG. 10, and a second position shown by dotted lines 86. When in the first and second positions, the tapered member directs the drive unit 26 and bobbin carriers 16 along the first and second branches 80 and 82 respectively. The tapered member 84 is moved between the first and second positions by an electromagnet 88 operating in conjunction with a spring 89. The electromagnet 88 receives control signals from the computing device 38, and these control signals control the position of the electromagnet 88 and thus of the tapered member 84. The computing device 38 controls similar direction changing devices at each junction of the track 2 in order to allow the drive unit 26 to travel to and from any part of the track 2.

Figure 11:
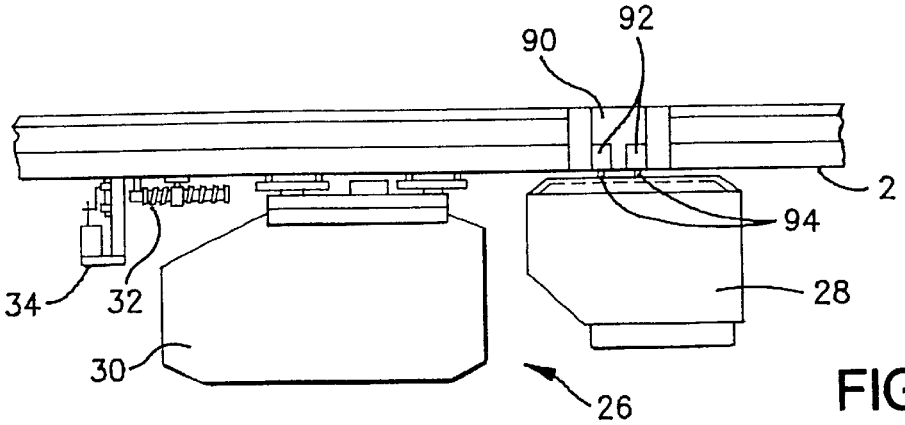
FIG. 11 shows the drive unit when located at a charging region of the bobbin track.
Figure 12:
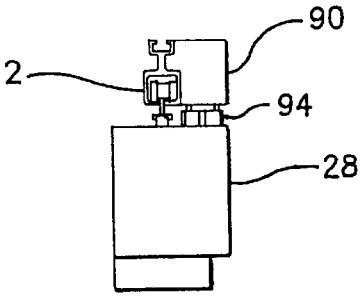
FIG. 12 is an end view of a battery unit forming part of the drive unit of FIGS. 3 and 11.

As shown in FIG. 11 a charging region 90 is provided on the connecting track 12 for charging rechargeable batteries (not shown) contained within the battery unit 28 of the drive unit 26. The charging region 90 is provided with two terminals 92 of a battery charging power supply (not shown). Two electrically conducting members 94 are provided at the top of the battery unit 28 for contacting the two terminals 92. When the rechargeable batteries of the battery unit 28 need recharging, the computing device 38 causes the drive unit 26 to stop in a position where the two electrically conducting members 94 contact the two terminals 92 thus enabling the battery to be recharged.

Figure 4:
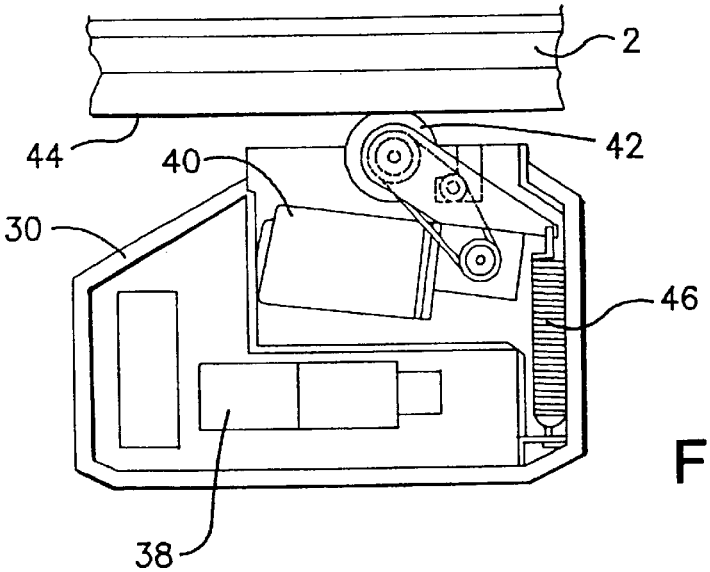
FIG. 4 shows a motor unit which forms part of the drive unit of FIG. 3.
Figure 13:
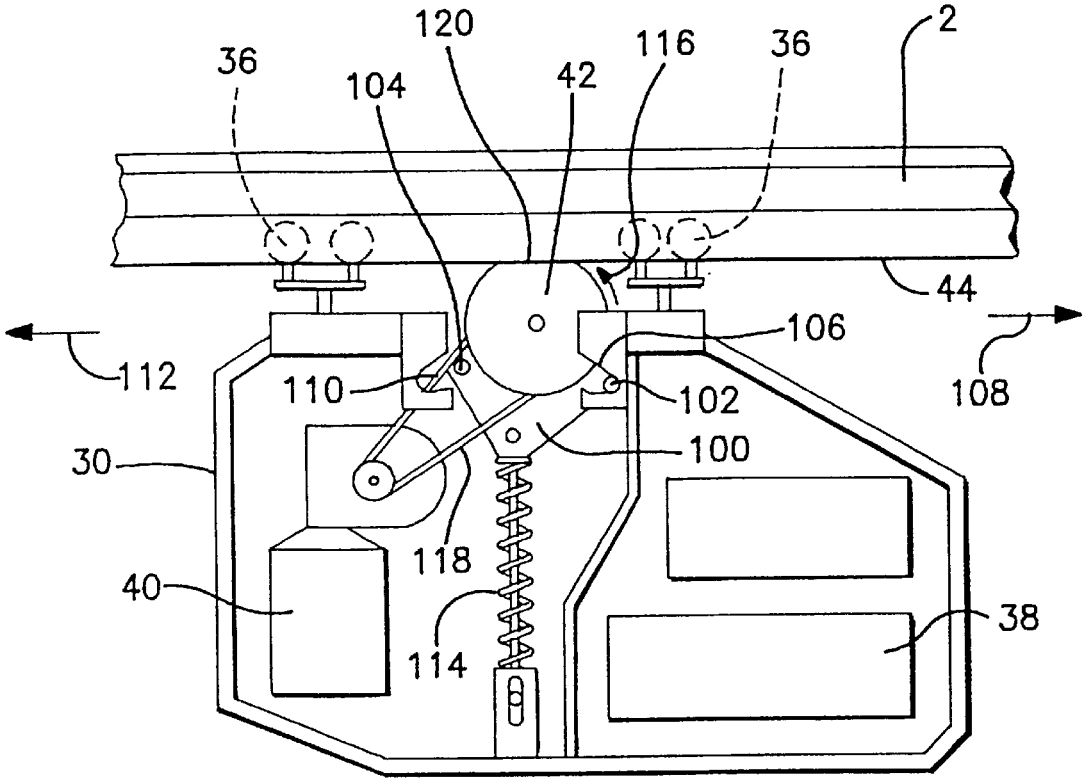
FIG. 13 is a schematic side view of an alternative embodiment of the motor unit of the drive unit.

FIG. 13 shows an alternative embodiment of the motor unit 30, in which similar components are labelled using the same reference numerals as in FIG. 4. The rubber wheel 42, which drives the motor unit 30 along the track 2, is rotatably mounted on a movable pivot plate 100 formed with first and second projections 102 and 104. The first projection 102 is adapted to engage within a first recess 106 when the rubber wheel 42 drives the motor unit 30 in the direction indicated by arrow 108, and the second projection 104 is adapted to engage within a second recess 110 when the rubber wheel 42 drives the motor unit 30 in the direction indicated by arrow 112. A spring 114 is connected to the bottom of the pivot plate 100 in order to bias the rubber wheel 42 in a direction away from the track 2.

In FIG. 13, the pivot plate is shown in its first position, in which the first projection 102 engages within the first recess 106, and the rubber wheel 42 rotates anticlockwise, as indicated by arrow 116, in order to drive the motor unit 30 in the direction of arrow 108. It will be appreciated that the greater the load which is transported by the motor unit 30, the more firmly the first projection 102 bears against the first recess 106, and the greater the pressure between the rubber wheel 42 and the track 2. This ensures that tic rubber wheel 42 grips the track 2 more firmly in the case of larger loads, so that there is always enough friction between the rubber wheel 42 and the track 2. In this embodiment, the toothed wheel 48 shown in FIG. 5 may be dispensed with.

When the rubber wheel 42 is driven in a clockwise direction in order to drive the motor unit in the direction of arrow 112, the pivot plate 100 automatically moves to the left so that the second projection 104 engages within the second recess 110, and the first projection 102 moves out of the first recess 106. The pivot plate 100 is then located in a second position (not shown), in which the required amount of friction between the rubber wheel 42 and the track 2 is again provided in the manner described above.

Because of the resilience of the rubber wheel 42, the top of the rubber wheel 42 forms a flat surface 120 against the lower side 44 of the track 2. The resilience of the rubber wheel 42 ensures that the rubber wheel 42 always maintains contact with the lower side 44 of the track 2 as the pivot plate 100 moves between its first and second positions. The rubber wheel 42 is driven by a drive belt 118, which is in turn driven by the motor 40. If necessary, the motor 40 and drive belt 118 can be arranged to move with the pivot plate 100, when the pivot plate 100 moves between its first and second positions, in order to ensure that the motor 40 continues to drive the rubber wheel 42 in both the first and second positions of the pivot plate 100.

What is claimed is:

1. A drive unit for driving one or more bobbin carriers along a track of a bobbin transport system, the drive unit comprising:

track engaging means for engaging with the track;

motor means for moving the drive unit along the track via said track engaging means;

detector means on the drive unit for detecting position indicators spaced along the track and for producing detector signals;

computer means on the drive unit for receiving said detector signals from the detector means and for computing the location of the drive unit on the basis of said detector signals, wherein the motor means comprise an electric motor for driving the drive unit along the track, and rechargeable battery for powering the electric motor, and the computer means includes means responsive to a low battery charge for stopping the drive unit in a region of the track equipped with means for recharging the rechargeable battery.

2. A drive unit for driving one or more bobbin carriers along a track of a bobbin transport system, the drive unit comprising:

track engaging means for engaging with the track;

motor means for moving the drive unit along the track via said track engaging means;

detector means on the drive unit for detecting position indicators spaced along the track and for producing detector signals;

computer means on the drive unit for receiving said detector signals from the detector means and for computing the location of the drive unit on the basis of said detector signals; and connection means for automatically connecting the drive unit to a bobbin carrier, said computing means including means responsive to contact between the drive unit and the bobbin carrier for stopping the drive unit and for immediately restarting the drive unit.

3. A drive unit for driving on or more bobbin carriers along a track of a bobbin transport system, the drive unit comprising:

a rotatably driven wheel for frictionally engaging with an underside of the track;

motor means for moving the drive unit along the track via said rotatably driven wheel, said motor means including pressure control means for increasing the pressure exerted by the wheel on the track as the load on the drive unit increases, so as to maintain sufficient frictional engagement between the wheel and the track;

detector means on the drive unit for detecting position indicators spaced along the track and for producing detector signals; and computing means on the drive unit for receiving said detector signals from the detector means and for computing the location of the drive unit on the basis of said detector signals.

* * * * *